US005181990A

United States Patent [19]

Arisaki et al.

[11] Patent Number: 5,181,990

[45] Date of Patent: Jan. 26, 1993

[54] PYROLYSIS FURNACE FOR OLEFIN PRODUCTION

[75] Inventors: Kenji Arisaki, Kawasaki; Hisashi Morimoto, Kure, both of Japan

[73] Assignee: Babcock-Hitachi Kabushiki Kaisha, Japan

[21] Appl. No.: 702,130

[22] Filed: May 16, 1991

Related U.S. Application Data

[63] Continuation of Ser. No. 449,349, Dec. 13, 1989, abandoned, which is a continuation of Ser. No. 3,390, Jan. 15, 1987, abandoned.

[30] Foreign Application Priority Data

Jan. 16, 1986 [JP] Japan ..... 61-4421[U]

[51] Int. Cl.[5] ..... C10G 9/18

[52] U.S. Cl. ..... 196/110; 196/116; 422/197; 422/204

[58] Field of Search ..... 196/110, 116; 422/196, 422/197, 204; 48/94, 123, 127.9; 585/648

[56] References Cited

U.S. PATENT DOCUMENTS

| | | | |
|---|---|---|---|
| 3,274,978 | 9/1966 | Palchik et al. | 196/110 |
| 3,671,198 | 6/1972 | Wallace | 422/197 |
| 4,014,749 | 3/1977 | Dormer et al. | 196/110 |
| 4,160,701 | 7/1979 | Dormer et al. | 196/110 |
| 4,412,975 | 11/1983 | Parizot et al. | 422/197 |
| 4,499,055 | 2/1985 | DiNicolantonio et al. | 422/197 |

FOREIGN PATENT DOCUMENTS

| | | | |
|---|---|---|---|
| 2713256 | 9/1978 | Fed. Rep. of Germany | 422/197 |
| 56-93792 | 7/1981 | Japan . | |

OTHER PUBLICATIONS

Yonezawa et al., "New radiant Coil Technology", *CEP* Dec. 1983 pp. 50-55.

*Primary Examiner*—Joye L. Woodard
*Attorney, Agent, or Firm*—Leydig Voit & Mayer

[57] ABSTRACT

A pyrolysis furnace for cracking hydrocarbons comprising a furnace; a pair of inlet tubes extending generally vertically within the furnace and connected to an outlet tube having a larger diameter than either of the inlet tubes and extending generally vertically within the furnace to an outlet; and burners for imparting radiant heat adjacent to the inlet tubes and adjacent to the outlet tube. The inlet tubes and the outlet tube define a single pass configuration through the furnace.

14 Claims, 4 Drawing Sheets

FIG. 12
PRIOR ART
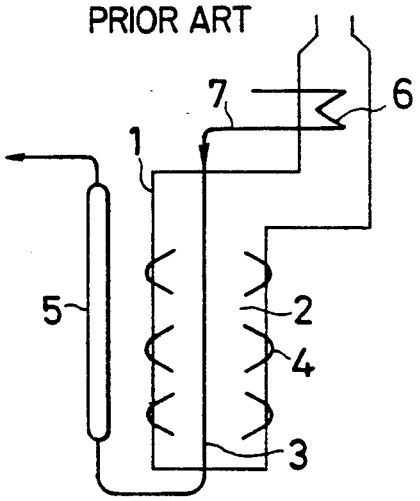
FIG. 13 PRIOR ART
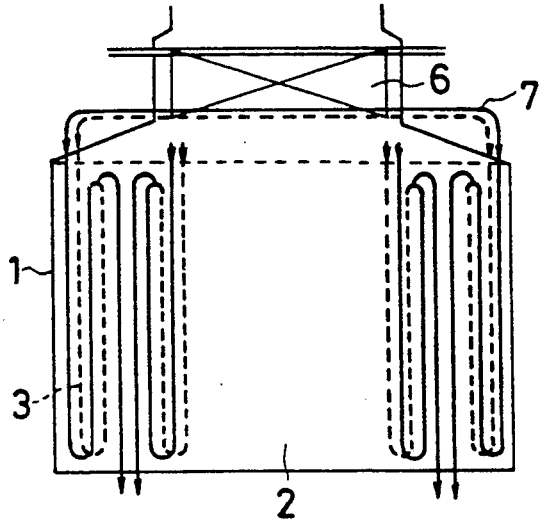
FIG. 14a
PRIOR ART
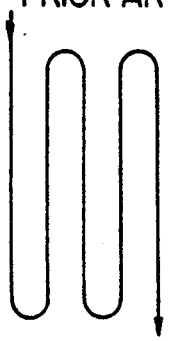
FIG. 14b
PRIOR ART
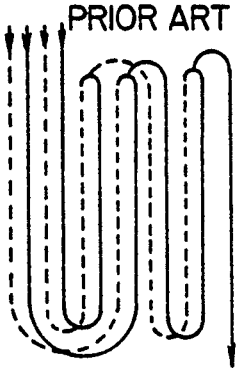
FIG. 14c
PRIOR ART
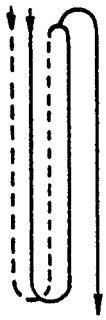
FIG. 14d
PRIOR ART
FIG. 15
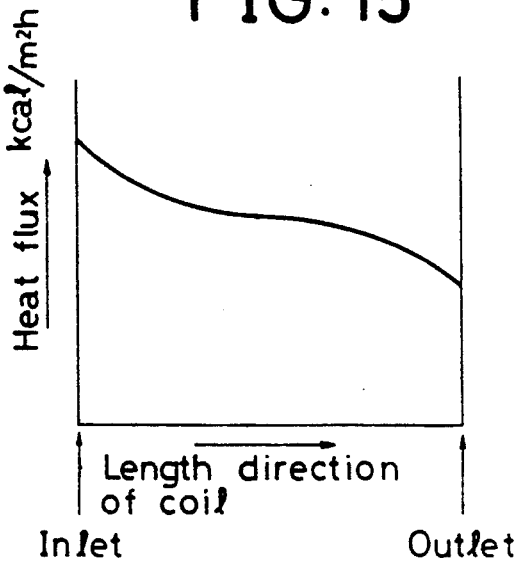
FIG. 16
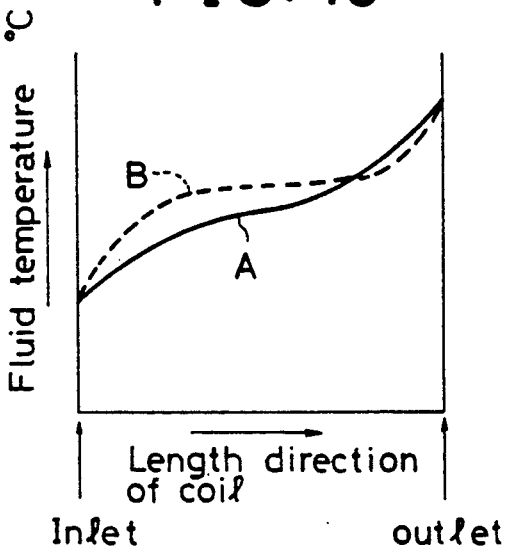

PYROLYSIS FURNACE FOR OLEFIN PRODUCTION

This application is a continuation-in-part application of application Ser. No. 07/449,349, filed on Dec. 13, 1989, which is a continuation application of application Ser. No. 07/003,390, filed on Jan. 15, 1987, both of which are now abandoned.

BACKGROUND OF THE INVENTION

1. Field of the Invention

This invention relates to a pyrolysis furnace for olefin production. More particularly it relates to a pyrolysis furnace suitable for optimizing the thermal cracking reaction of a fluid inside the tubes thereof.

2. Description of the Invention

As to the pyrolysis furnace of hydrocarbons including naphtha, it has been suggested to make the furnace multi-purpose, for example, improvement in not only the yield of ethylene as main product, but also that of propylene as byproduct, or change in the proportion of these two, and also a notable change in the shape of radiant tubes causing the reaction has been brought about.

For example, FIGS. 12 and 13 illustrate a conventional and general structure of the furnace, and radiant tubes 3 are arranged at the lengthwise center of a furnace 2 in the body of a pyrolysis furnace 1. A plurality of burners 4 are provided on the lateral surface of the furnace on both the sides of the tubes, and as shown in FIG. 12, radiant tubes of various types are provided and have been respectively used so as to correspond to their use objects. The type 1 (FIG. 14*a*) is of the most orthodox tube shape constituting one pass both on the inlet side and on the exit side, and the shapes of the type 2 (FIG. 14*b*) and the type 3 (FIG. 14*c*; Japanese patent application laid-open No. 56-93792/1981) based on the type 1 have come to be the recent main types employed. These types are referred to as confluence mode types wherein multiple passes are constituted on the inlet side of the tubes, the respective tubes are joined together at the middle part and one pass is constituted on the exit side thereof. Tubes of relatively small diameter are used at the multiple pass part and after joining, tubes of a large diameter are used to thereby generally equalize the fluid flow rate inside the tubes.

FIG. 15 shows the heat flux distribution along the length of the radiant tubes in the furnace, and it is necessary to raise the fluid temperature of hydrocarbons so as to correspond to this heat flux. FIG. 16 shows the fluid temperature inside the tubes in the tube length direction. From the viewpoint of the reaction inside the tubes, since it is ideal to shorten the retention time of hydrocarbons inside the furance, it is desired to raise the temperature of the fluid at the inlet part of the tubes as soon as possible. Thus this desire is to be directed to line B of FIG. 16. In order to effect this mode, it is necessary that the heat transferability on the inlet side of the tubes is as great as possible. Thus, by making the tubes multiple passes and also making the diameter of the respective tubes smaller, increase in the quantity of heat transfer i.e. the heat flux is obtained.

The type 4 (FIG. 14*d*) has been referred to as a straight type wherein the tube is of one pass both on the inlet side and on the exit side.

As described above, it is necessary to make the tubes multiple pass tubes and also to make the diameter of the tubes smaller, but if this is applied to types 1 and 4, one cannot help employing an exceedingly severe operation such as feed of a heat flux on a very high level. Thus, taking into account the upper limit of the metal temperature on the exit side, the temperature rise on the inlet side should be suppressed by all means. As a result, types 1 and 4 come to exhibit curve A in FIG. 16. This has undesirable effects on the reaction. Since all tubes have small diameter as far as the exit side, increase in the flow quantity of the fluid accompanying the decomposition reaction makes the pressure loss inside the tubes great.

On the other hand, since types 2 and 3 each employ a constitution of multiple passes of tubes of small diameter only on the inlet side of the tubes the types exhibit curve B in FIG. 16; hence this is ideal as far as the temperature rise of fluid is concerned. However, any tube construction of types 1, 2 and 3 are of hair pin structure having return bends (180° bends); hence the pressure loss at the bend parts occupies a large proportion of the total pressure loss. Thus, since it is necessary to keep the fluid pressure on the exit side of the tube to a definite value, it is necessary in the case of such types to raise the pressure on the inlet side, too, as compared with type 4.

On the other hand, in the olefin formation reaction by pyrolysis, reduction in the hydrocarbon partial pressure inside the tubes more promotes the reaction along with the above temperature distribution. Thus it is better to reduce the pressure loss of the fluid inside the tubes. In this sense, a structure free of such bend is preferred; hence the type 4 is ideal. However, since this makes it impossible to ensure the tube length of the tubes in the aspect of heat transfer, it is necessary to make tubes of small diameter with a multiple pass configuration; hence the above-mentioned problem is still raised. Accordingly, the above arrangement has been employed only in a certain cases, and currently the arrangement has not been widely employed.

SUMMARY OF THE INVENTION

The object of the present invention is to provide a pyrolysis furnace which employs tubes of the confluence mode of types 2 and 3 in the prior art, but which overcomes the drawbacks thereof, that is, it (1) ensures that the necessary heat transfer on the tube inlet side is maintained, (2) is free of a return bend structure, thereby reducing the pressure loss inside the tubes, and (3) enables a tube arrangement which has so far been substantially impossible to effect and which reduces the space occupied by the tubes.

The present invention provides a pyrolysis furnace for olefin production having reaction tubes for cracking hydrocarbons provided therein. The furnace includes vertically arranged tubes composed of two or more passes on the inlet side of the fluid and one pass on the exit side thereof, the respective passes being joined together inside the furnace. The tubes on the exit side are of a larger diameter than the tubes on the inlet side and the tubes do not include any bend parts.

BRIEF DESCRIPTION OF THE DRAWINGS

FIG. 12 and 13 show a conceptional views of a conventional pyrolysis furnace.

FIG. 14*a–d* show conventional embodiments of the tube form.

FIG. 15 shows a chart illustrating the heat flux distribution in the length direction of the conventional tube.

FIG. 16 shows a chart illustrating the fluid temperature distribution inside the tubes of the conventional embodiment in the length direction thereof.

DETAILED DESCRIPTION OF PREFERRED EMBODIMENTS

The present invention will be described in more detail by way of Examples and with reference to the

EXAMPLE 1

This Example is directed to a case where the inlets of the tubes of the furnace are provided at the lower part of the furnace.

Figure 1:
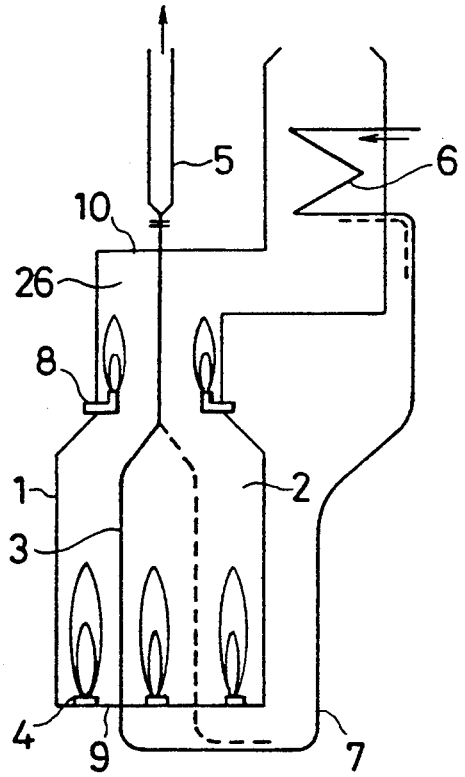
FIG. 1 shows a conceptional view illustrating an embodiment of the present invention.

FIG. 1 shows a conceptional view illustrating an embodiment of the present invention, as described above. The furnace 2 has a convectional part 26 of a shape wherein the lower part is broad and the upper part is narrow, and at the lower part, radiant tubes 3 are arranged in two rows in the width direction of the furnace. These tubes are arranged such that, when they are combined, they form one row along the center of the furnace in the length direction thereof by the medium of bends at the middle part of the furnace. At the lower part of the furnace, burners 4 are arranged in three rows so as to uniformly heat the respective radiant tubes 3 from both the sides thereof control burners 8 are separately arranged for the same purpose after the tubes are joined into one row. In addition, due to the burners 4 and the control burners 8 arranged at two stages, it is possible to control the quantity of heat transfer on the inlet side of the tubes and that on the exit side thereof.

Figure 2:
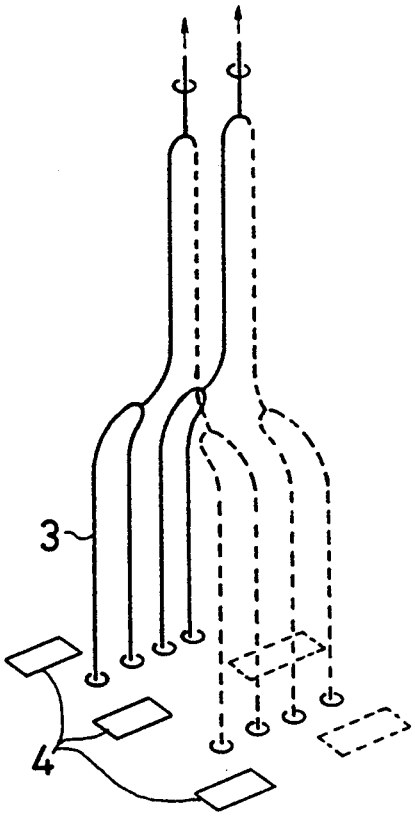
FIG. 2 shows an explanatory view of an embodiment of the piping thereof.

FIG. 2 shows an explanatory view illustrating the shape of the radiant tubes. As to the confluence manner of the tubes, as shown in FIG. 3, it is also possible to make the tubes multiple passes, i.e., more than two passes, on the inlet side, then join them into one pass on the exit side, respectively, thereafter again join the respective one passes at the exit part, and lead to the succeeding quencher. In addition, FIG. 3 (*a*) refers to 4-2-1 system tubes and FIG. 3 (*b*) refer to 6-2-1 system tubes.

Figures 3A, 3B:
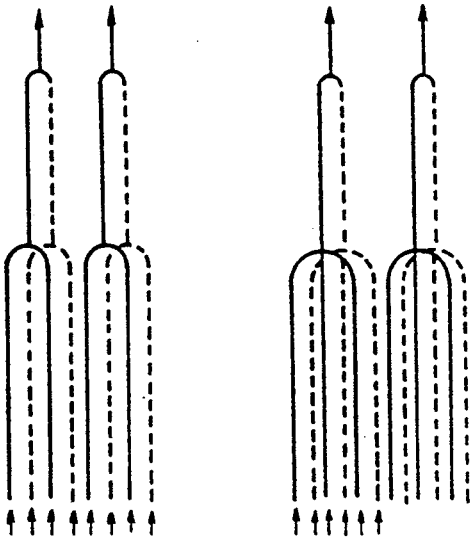
FIG. 3*a* and 3*b* show an embodiment of the respective piping forms, respectively.
Figure 4:
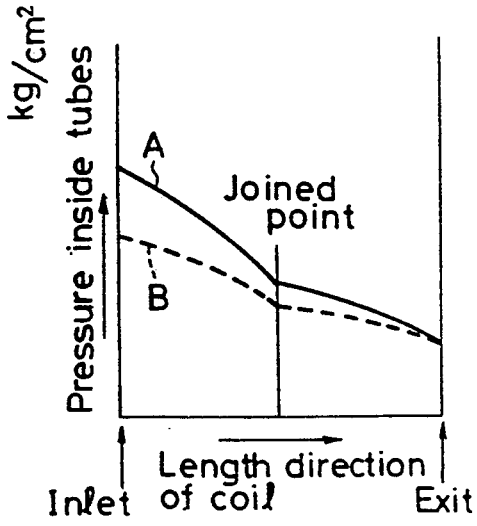
FIG. 4 shows a chart illustrating the relationship between the length direction of the piping and the pressure distribution inside the tubes.

The function of this Example will be explained by referring to FIG. 1. A process fluid is preheated by a convection coil 6 and then introduced into a furnace 2 in two rows in the length direction of the furnace at the bed part of the furnace via a crossover tube 7. Radiant tubes 3 enter the furnace at the bed part thereof, ascend inside the furance 2 up to the middle part thereof where they are joined by means of bends and joining fittings, and the joined tube further ascends in a one row arrangement along the center of the furnace in the length direction thereof and is then introduced through the ceiling 10 of the furnace into the succeeding quencher 5. The portions of the radiant tubes and the joined tube near the bends and joining fittings can be considered an intermediate tube having two inlets and one outlet. The radiant tubes 3 may be again joined with the respective adjacent tubes at the exit part located at the upper part of the furnace, as shown in FIG. 2. At the lower part of the furnace 2, burners 4 are arranged on both the sides of the radiant tubes 3 arranged in two rows to make it possible to uniformly heat the tubes through radiation. Further, on the tubes exit side after confluence into one pass at the upper part of the furnace, controlling burners 8 are arranged on both the sides of the tube According to such a structure, as shown by B of FIG. 16, it is possible to achieve rapid elevation of the fluid temperature on the tube inlet side, by adequately selecting the burners 4 relative to tubesharing multiple passes and having a smaller diameter, while it is also possible to control the fluid temperature on the exit side by controlling the controlling burners 8. For example, the temperature of decomposition into and formation of propylene is 820° C. and that of decomposition into and formation of ethylene is 870° C. If it is intended to form ethylene in a larger quantity, this can be effected by increasing the transfer quantity by means of control burners 8. Depending on the extent of the fluid temperature distribution required, the configuration of the tubes may be as shown in FIGS. 3*a* and 3*b*. Further, FIG. 4 illustrates the pressure distribution inside the radiant tubes 3 wherein A shows the case of conventional tubes and the pressure loss at the above return bend part occupies about 30% of the total, whereas according to the tubes of this Example, it is possible to be free from the most part of the pressure loss at the bend part, as shown by B of FIG. 4.

According to this Example, in order to increase the quantity of heat transfer on the tube inlet side, tubes having a smaller diameter and multiple passes are constituted and at the same time, no 180° bend is used, whereby it is possible to achieve the object of the present invention. Further, by employing a two-row arrangement at the lower part of the furnace (i.e. on the tube inlet side), it is possible to reduce the space required by the arrangement down to half of that in the case of conventional one-row arrangement, and also particularly in the case of three passes or more on the inlet side, tubes which have been substantially impossible structurally to arrange, have become possible to easily arrange; thus the effectiveness of the present invention is very great.

EXAMPLE 2

This Example shows a case where the inlet of the tubes of the furnace is provided at the upper part of the furnace.

Figure 5:
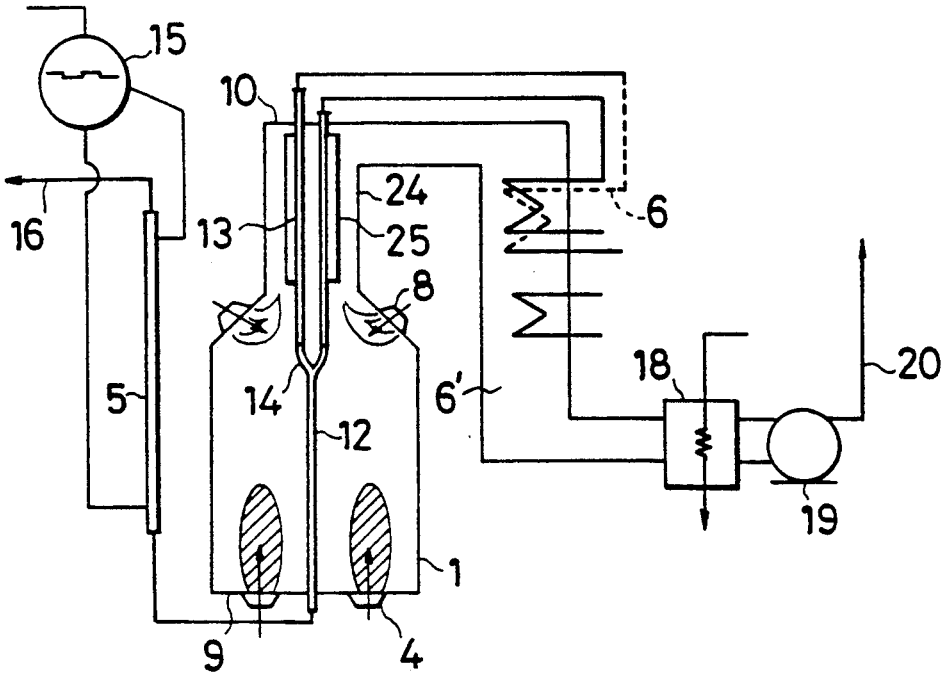
FIG. 5 shows a view illustrating another embodiment.

FIG. 5 shows a conceptional view illustrating a pyrolysis furnace of another embodiment of the present invention. In this figure, radiant tubes (reaction tubes) 12 and 13 are vertically arranged along the center of the body 1. Burners 4 are arranged on both sides of the tubes so as to place the tubes therebetween and controlling burners 8 are arranged at the ceiling arch part of the furnace. The burners 4 on both sides of the reaction tubes are located substantially beneath the bends, i.e., intermediate tube, 14. A hydrocarbon as raw material is preheated by a convection coil 6 present in a convection bank 6', flows through radiant tube inlets into radiant tubes 13 penetrating through the ceiling 10, descends vertically, joins together at bends 14 positioned at the middle part, further flows down vertically through tubes 12, flows out of the exit at the furnace bed, and is quenched by a quencher 5, and its sensible heat is recovered as high pressure steam at a steam drum 15. On the other hand, a cracked gas 16 is obtained. The combustion exhaust gas is discarded into the atmosphere, if necessary, through an IP heater 18 and an IDF 19 from a stack 20.

Figure 6:
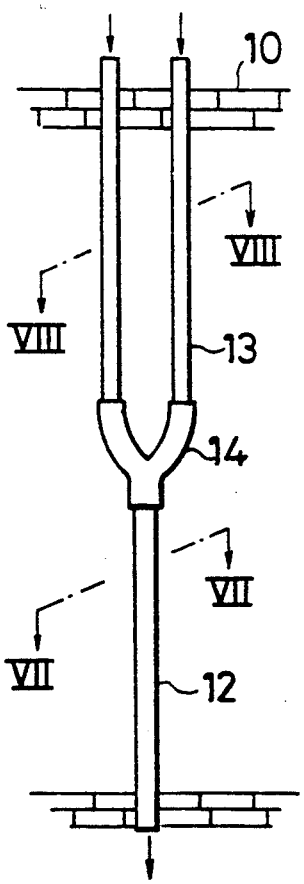
FIG. 6 shows an explanatory view illustrating the joined part of the coils.
Figure 7:
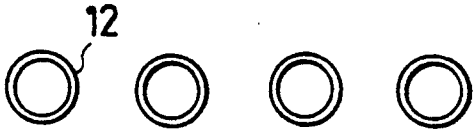
FIG. 7 shows a cross-sectional view of FIG. 6 along the line of A—A.
Figure 8:
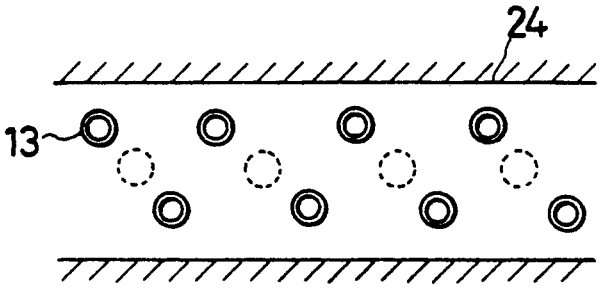
FIG. 8 shows a cross-sectional view of FIG. 6 along the line B—B.
Figure 9:
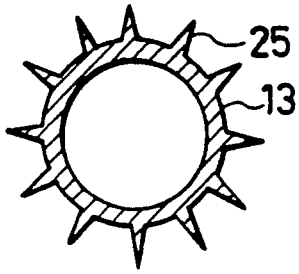
FIG. 9 shows a cross-sectional view in the case where fins are provided in the tubes.
Figure 11:
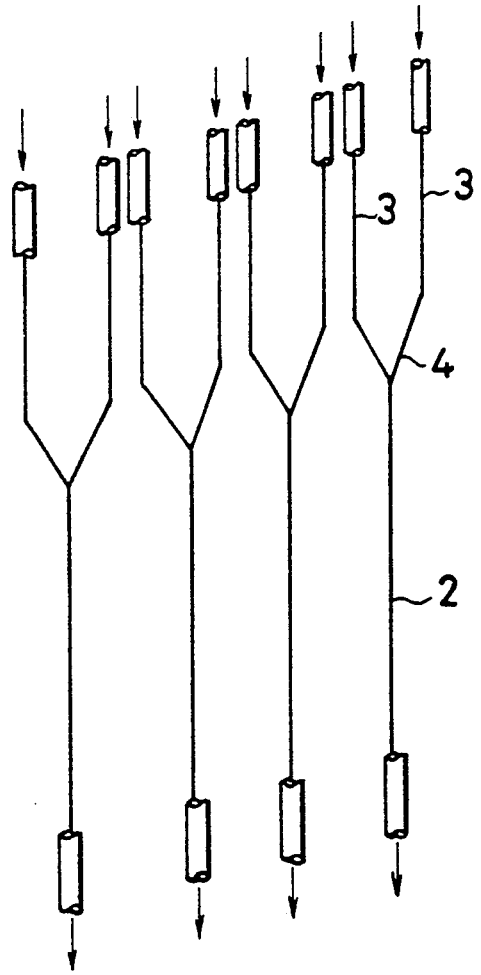
FIG. 11 shows a view illustrating an embodiment of a tube form.

As the tubes those in the form of a fork as shown in FIG. 6 are arranged continuously in the length direction of the furnace as shown in FIG. 11. When the tube arrangement is viewed in the direction of line A—A of FIG. 6, a one-row on-line formation is made as shown in FIG. 7, while when it is viewed in the direction of line B—B of FIG. 6, a two-row, zigzag arrangement is formed. At the upper part of the furnace where the tubes 13 are arranged, a lateral wall 24 is formed so as to narrow the flow path of the combustion gas, as shown in FIG. 5. Thus, all the tubes 12 are subject to a heating system consisting mainly of radiant heat transfer inside the furnace, while the most part of the tubes 13 are subject to a heating system consisting mainly of convectional heat transfer. Further, if necessary, lengthwise fins 25 are provided on the tubes 13, as shown in FIG. 9, whereby heat transfer is further promoted. In other words, as shown in FIG. 8, inlet tubes 13 may be arranged in two rows to reduce the volume within the furnace required by the inlet tubes and those inlet tubes may include, as shown in FIG. 9, lengthwise fins for improving heat transfers.

Figure 10:
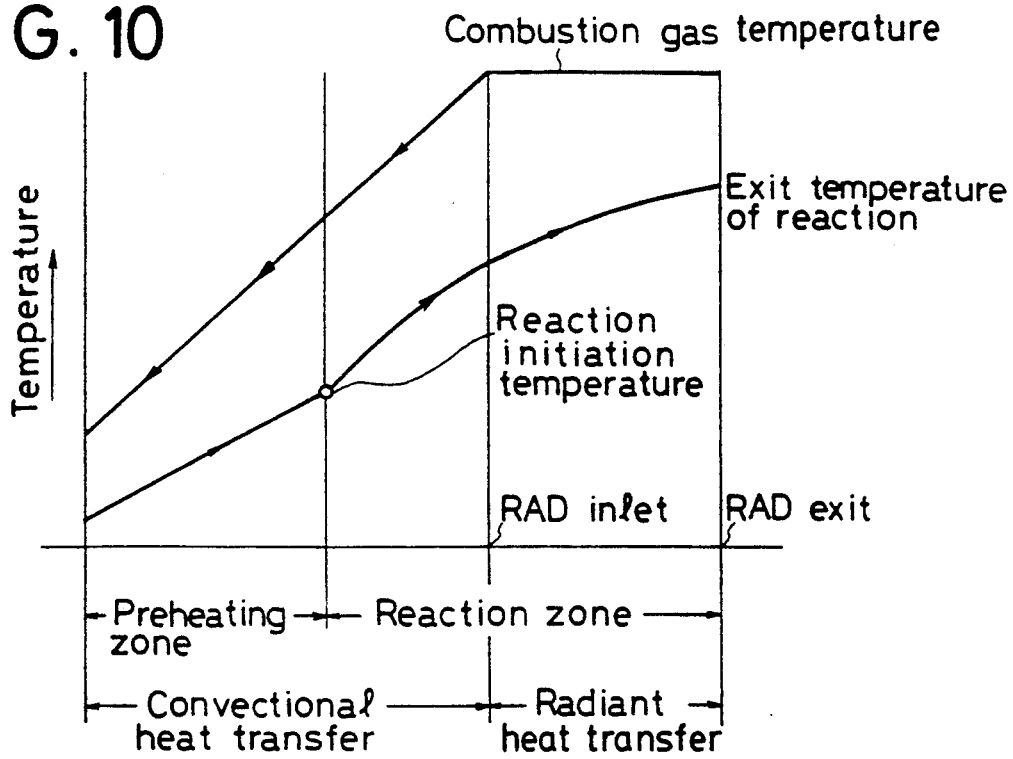
FIG. 10 shows a chart illustrating the temperature characteristics of the pyrolysis furnace of the above-mentioned other embodiment.

Now, the state of heat transfer shown in the embodiment of FIG. 5 will be described referring to FIG. 10. Heretofore, the decomposition reaction has been carried out only by the radiant heat inside the furnace, whereas according to this embodiment, there is provided a convectional part having the upper part of the furnace narrowed, where the reaction is initiated; hence the reaction initiation occurs in the convectional zone, and at the inlet of the radiant heat transfer part, a considerable reaction has already advanced. Since the reaction heat is constant, the absolute quantity of heat transfer is reduced; hence a quantity of the fuel fed may be decreased.

As described above in detail, according to the present invention, it is possible to arrange the so-called combined tubes wherein tubes in the form of multiple passes and having a small diameter are constituted on the tube inlet side of the furnace and they are joined together at the middle part thereof, without employing any bend, to thereby reduce the pressure loss, and it is also possible to notably reduce the arrangement space as compared with that in the case of the prior art. Further, in the case of three passes or more, it is structurally possible to arrange the tubes in a manner not heretofore possible in the case of a conventional one pass arrangement. Furthermore, since the inside of the furnace is separated into an upper part and a lower part of the inlet side and on the exit side, respectively, control of the quantity of heat transfer is more improved than that in the case of conventional system to thereby make it possible to more approach its optimization. Thus, the extent of contribution of the present invention is very great.

The preferred embodiments of the present invention can provide a pyrolysis furnace which is based on the tubes of the confluence mode of types 2 and 3 in the prior art, but has overcome the drawbacks thereof. The preferred embodiments can ensure the quantity of heat transfer required on the tube inlet side and at the same time is free of a return bend structure to thereby reduce the pressure loss inside the tubes. Furthermore, the preferred embodiments can enable the use of a tube arrangement which has so far been substantially impossible to effect and also can reduce the space where the tubes are arranged.

What we claim is:

1. A pyrolysis apparatus for cracking hydrocarbons to form olefins comprising:

a furnace having an upper part and a lower part, said upper part being narrower than said lower part;

a pair of inlet tubes supported in said upper part and extending generally vertically within said furnace from respective inlets for an unreacted hydrocarbon feed;

an outlet tube joined to said inlet tubes and supported in said lower part and having a larger diameter than either of said inlet tubes and extending generally vertically within said furnace to an outlet for cracked hydrocarbons;

said inlet and outlet tubes defining a hydrocarbon flow path extending from said inlets through said inlet tubes and, after confluence, through said outlet tube to said outlet, the hydrocarbon flow path extending in a single direction without returning toward said inlets; and heating means controlled to provided a predetermined temperature profile in the hydrocarbons flowing through the tubes.

2. A pyrolysis apparatus for cracking a hydrocarbon feed to form olefins comprising:

a furnace having a lower part and an upper part, said upper part being narrower than said lower part;

a pair of single pass inlet tubes located in said upper part and extending generally vertically within said furnace and joined within said furnace to a single pass outlet tube located in said lower part and extending generally vertically within said furnace, said inlet tubes having a smaller diameter than said outlet tube thereby to increase heat transfer to the hydrocarbon feed in said inlet tubes compared with said outlet tube, said inlet and outlet tubes providing a hydrocarbon feed flow path extending in a single pass without reverse bends vertically through said furnace thereby to minimize pressure drop; and heating means for providing a predetermined substantially uniformly increasing temperature profile of the hydrocarbon feed flowing through said tubes within said furnace by providing gradually increasing heat transfer to the hydrocarbon feed flowing through said inlet tubes and heat transfer decreasing thereafter to the hydrocarbon feed flowing through said outlet tube.

3. A pyrolysis apparatus for cracking hydrocarbons comprising:

a furnace having inlet and outlet sides, an upper convectional heating part, and a lower part wherein the upper convectional heating part of the furnace is narrower than the lower part of the furnace and the upper convectional heating part and the lower part of the furnace are located on the inlet and outlet sides of the furnace, respectively; and vertically arranged reaction tubes located within the furnace wherein each reaction tube includes at least two inlet tubes having diameters, an intermediate tube having at least two inlets and one outlet, and an outlet tube having a diameter wherein the diameter of said outlet tube is larger than the diameter of an inlet tube and said reaction tubes do not have a substantially 180° bend part.

4. A pyrolysis apparatus according to claim 3 wherein main burners for imparting radiant heat are provided in the vicinity of the inlet side of the furnace and control burners for imparting radiant heat are provided in the vicinity of the intermediate tubes.

5. A pyrolysis apparatus according to claim 4 including control burners provided at said upper convectional heating part.

6. A pyrolysis apparatus according to claim 3 including control burners provided at said upper convectional heating part.

7. A pyrolysis apparatus for cracking hydrocarbons comprising:

a furnace having inlet and outlet sides, an upper convectional heating part, and a lower part wherein the upper convectional heating part of the furnace is narrower than the lower part of the furnace and the upper convectional heating part and the lower part of the furnace are located on the inlet and outlet sides of the furnace, respectively;

vertically arranged reaction tubes located within the furnace wherein each reaction tube includes at least two inlet tubes having diameters, an intermediate tube having at least two inlets and one outlet, and an outlet tube having a diameter wherein the diameter of said outlet tube is larger than the diameter of an inlet tube and said reaction tubes do not have a substantially 180° bend part;

main burners for imparting radiant heat provided in the vicinity of the outlet side of the furnace; and control burners for imparting radiant heat provided in the vicinity of the intermediate tubes.

8. A pyrolysis apparatus for cracking hydrocarbons comprising a furnace; vertically arranged reaction tubes located within the furnace, wherein each reaction tube includes at least two inlet tubes coupled to one outlet tube, the diameter of the outlet tube is greater than that of an inlet tube, the inlet and outlet tubes define a hydrocarbon flow path extending through the furnace substantially in a single direction without substantially returning toward said inlets; and a plurality of main burners provided adjacent to at least two sides of an inlet tube for imparting radiant heat to the inlet tube, wherein at least one of the main burners is substantially between two inlet tubes.

9. A pyrolysis apparatus according to claim 8 wherein the at least two inlet tubes are coupled to the one outlet tube by an intermediate tube having at least two inlets and one outlet.

10. A pyrolysis apparatus according to claim 9 wherein at least one of the main burners is located substantially under the intermediate tube.

11. A pyrolysis apparatus according to claim 10 wherein the main burners are arranged in three rows for uniformly heating the inlet tubes from opposite sides.

12. A pyrolysis apparatus according to claim 11 wherein the inlet tubes are arranged in two rows for reducing the space required by the inlet tubes within the furnace and wherein the inlet tubes include length wise fins for increasing heat transfer.

13. A pyrolysis apparatus according to claim 9 wherein the furnace includes control burners for imparting radiant heat, the control burners being located in the vicinity of the intermediate tubes.

14. A pyrolysis apparatus according to claim 8 wherein the furnace has inlet and outlet sides, an upper convectional heating part and a lower part, the upper convectional heating part of the furnace is narrower than the lower part of the furnace, the lower and upper parts of the furnace are located on the inlet and outlet sides of the furnace, respectively, and control burners are provided at said upper convectional heating part.

* * * * *